US009195168B2

(12) United States Patent
Ishii et al.

(10) Patent No.: US 9,195,168 B2
(45) Date of Patent: Nov. 24, 2015

(54) DEVELOPING DEVICE AND IMAGE FORMING APPARATUS

(71) Applicant: FUJI XEROX CO., LTD., Minato-ku, Tokyo (JP)

(72) Inventors: Yasutomo Ishii, Kanagawa (JP); Shinichi Kuramoto, Kanagawa (JP); Hiroaki Okuma, Kanagawa (JP); Ryota Tomishi, Kanagawa (JP); Shinji Okuyama, Kanagawa (JP); Kiyohito Horii, Kanagawa (JP); Daisuke Nakai, Kanagawa (JP); Ryo Fukuno, Kanagawa (JP); Toshiaki Suzuki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/326,668

(22) Filed: Jul. 9, 2014

(65) Prior Publication Data

US 2015/0016848 A1 Jan. 15, 2015

(30) Foreign Application Priority Data

Jul. 11, 2013 (JP) ..... 2013-145563
Mar. 7, 2014 (JP) ..... 2014-045376

(51) Int. Cl.
*G03G 21/20* (2006.01)
*G03G 15/08* (2006.01)

(52) U.S. Cl.
CPC ..... *G03G 15/0846* (2013.01); *G03G 15/0887* (2013.01); *G03G 15/0896* (2013.01)

(58) Field of Classification Search
CPC ..... G03G 15/0806; G03G 15/0846; G03G 15/0887; G03G 15/0896
USPC ..... 399/91, 119, 265
See application file for complete search history.

(56) References Cited

U.S. PATENT DOCUMENTS

| | | | | |
|---|---|---|---|---|
| 4,800,411 | A * | 1/1989 | Tanaka et al. | 399/103 |
| 5,995,780 | A * | 11/1999 | Wayman | 399/93 |
| 2009/0060560 | A1 * | 3/2009 | Tamura et al. | 399/92 |
| 2009/0208254 | A1 * | 8/2009 | Fukuyama et al. | 399/264 |

FOREIGN PATENT DOCUMENTS

| | | | |
|---|---|---|---|
| JP | 2003-076142 | A | 3/2003 |
| JP | 2005-346035 | A | 12/2005 |
| JP | 2006-250973 | A | 9/2006 |
| JP | 2008-039965 | A | 2/2008 |
| JP | 2011-215567 | A | 10/2011 |

* cited by examiner

*Primary Examiner* — Benjamin Schmitt
(74) *Attorney, Agent, or Firm* — Sughrue Mion, PLLC

(57) ABSTRACT

A developing device includes a developer carrier that has a cylindrical shape and that rotates while carrying developer to supply the developer to an image carrier on which an electrostatic latent image is formed, a container that contains the developer carrier, and a discharge-path forming member that is provided along an outer peripheral surface of the developer carrier, that covers a top portion of a path along which the outer peripheral surface moves, the top portion being located at an uppermost position of the path, and that forms a discharge path, through which air is discharged from inside of the container to outside of the container, between the discharge-path forming member and an inner wall surface of the container, the discharge path having an outlet located closer to the developer carrier than the top portion.

8 Claims, 11 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2013-145563 filed Jul. 11, 2013 and Japanese Patent Application No. 2014-045376 filed Mar. 7, 2014.

BACKGROUND

Technical Field

The present invention relates to a developing device and an image forming apparatus.

SUMMARY

According to an aspect of the invention, there is provided a developing device including a developer carrier that has a cylindrical shape and that rotates while carrying developer to supply the developer to an image carrier on which an electrostatic latent image is formed; a container that contains the developer carrier; and a discharge-path forming member that is provided along an outer peripheral surface of the developer carrier, that covers a top portion of a path along which the outer peripheral surface moves, the top portion being located at an uppermost position of the path, and that forms a discharge path, through which air is discharged from inside of the container to outside of the container, between the discharge-path forming member and an inner wall surface of the container, the discharge path having an outlet located closer to the developer carrier than the top portion.

BRIEF DESCRIPTION OF THE DRAWINGS

An exemplary embodiment of the present invention will be described in detail based on the following figures, wherein:

FIG. 6 is a graph showing the relationship between the gap of the outlet and the amount of toner that adheres to a medium or the like;

DETAILED DESCRIPTION

1. Exemplary Embodiment 1-1. Overall Structure of Image Forming Apparatus

Figure 1:
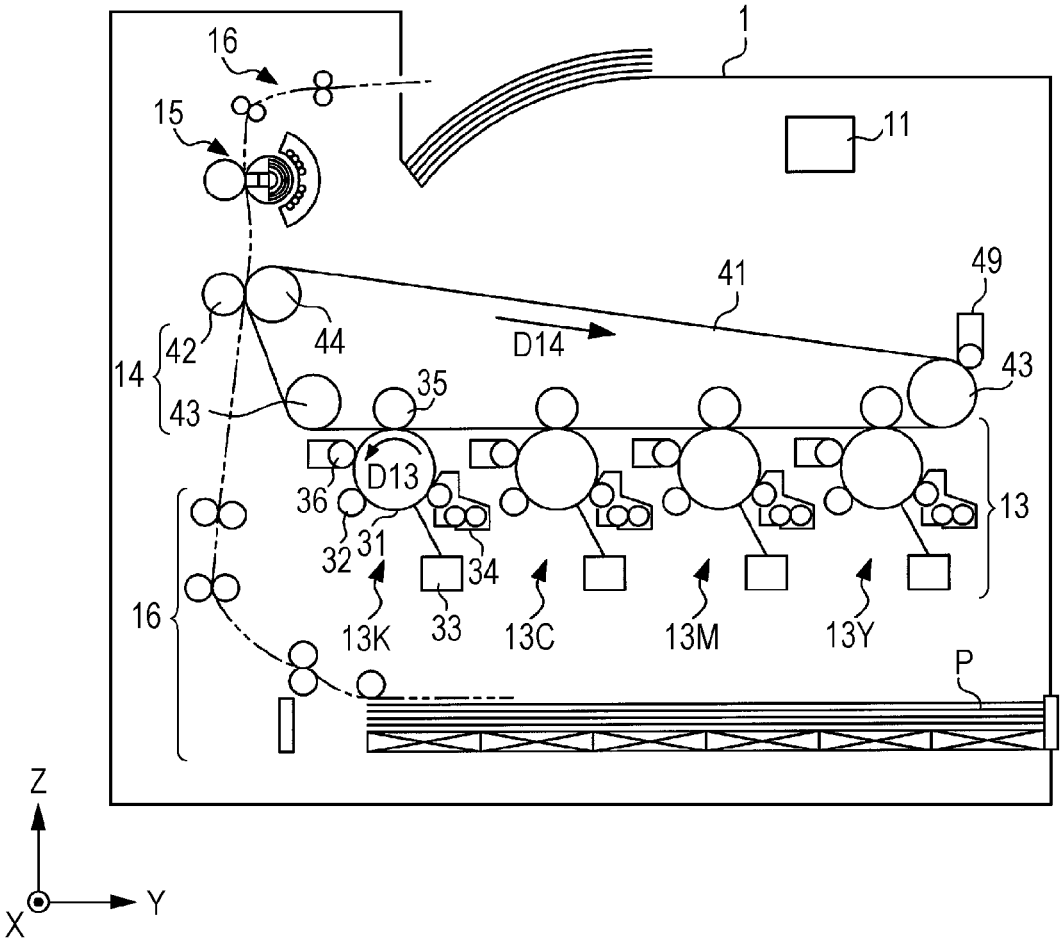
FIG. 1 illustrates the overall structure of an image forming apparatus according to an exemplary embodiment.

FIG. 1 illustrates the overall structure of an image forming apparatus 1 according to an exemplary embodiment of the present invention. In the following description, to describe the arrangement of components of the image forming apparatus 1, the space in which the components are arranged is represented by an xyz right-handed coordinate system. Of the symbols of the coordinate system illustrated in each figure, the white circle with a black dot therein represents an arrow in the direction from the far side to the near side in the figure. The white circle with two crossing lines therein represents an arrow in the direction from the near side to the far side in the figure. In the space, the direction along the x-axis is referred to as an X-axis direction. In the X-axis direction, the direction in which the x component increases is referred to as a +X direction, and the direction in which the x component decreases is referred to as a −X direction. Similarly, a Y-axis direction, a +Y direction, a −Y direction, a Z-axis direction, a +Z direction, and a −Z direction are defined for the y and z components.

As illustrated in FIG. 1, the image forming apparatus 1 includes a controller 11, developing units 13Y, 13M, 13C, and 13K, a transfer unit 14, a fixing unit 15, and a transport unit 16. The letters Y, M, C, and K appended to the reference numeral 13 respectively represent yellow, magenta, cyan, and black toners. The developing units 13Y, 13M, 13C, and 13K basically have similar structures except for the color of the toner contained therein. When it is not necessary to distinguish the developing units 13Y, 13M, 13C, and 13K from each other, the developing units will be referred to simply as "developing units 13" without the letters representing the toner colors appended at the end.

The controller 11 includes a storage unit such as a central processing unit (CPU), a read only memory (ROM), a random access memory (RAM), a solid state drive, or a hard disc drive. The CPU reads computer programs stored in the storage unit and executes the programs to control each part of the image forming apparatus 1.

The transport unit 16 includes a container and transport rollers. The container contains sheets of paper P that are cut into a predetermined size in advance and that serve as media. The sheets of paper P contained in the container are fed one at a time by the transport rollers and transported to the transfer unit 14 along a sheet transport path in accordance with an instruction of the controller 11. The media are not limited to sheets of paper, and may instead be, for example, resin sheets. The media are not particularly limited as long as images may be recorded on the surfaces thereof.

Each developing unit 13 includes an image carrier 31, a charging device 32, an exposure device 33, a developing device 34, a first transfer roller 35, and a drum cleaner 36. The image carrier 31 is a photoconductor drum that includes a charge generating layer and a charge transport layer, and is rotated in the direction of arrow D13 in FIG. 1 by a drive unit (not shown). The charging device 32 charges the surface of the image carrier 31. The exposure device 33 includes a laser source and a polygonal mirror (neither is shown). The exposure device 33 is controlled by the controller 11 so as to emit a laser beam corresponding to image data toward the image carrier 31 that has been charged by the charging device 32. Thus, an electrostatic latent image is formed on the image carrier 31. The controller 11 may receive the above-described image data from an external device through a communication unit (not shown). The external device may be, for example, a reading device capable of reading an original image or a storage device that stores data representing an image. The developing device 34 supplies developer to the image carrier 31. Thus, an image is formed (developed) on the image carrier 31.

The first transfer roller 35 generates a predetermined potential difference between the image carrier 31 and an intermediate transfer belt 41 included in the transfer unit 14 at a position where the image carrier 31 faces the intermediate transfer belt 41. Owing to the potential difference, the image is transferred onto the intermediate transfer belt 41. The drum cleaner 36 removes the toner that has not been transferred and that remains on the surface of the image carrier 31 after the transferring of the image, and also removes the electricity from the surface of the image carrier 31.

The transfer unit 14 includes the intermediate transfer belt 41, a second transfer roller 42, belt transfer rollers 43, a back-up roller 44, and a belt cleaner 49. The transfer unit 14 transfers the images formed by the developing units 13 onto a sheet of paper P. The intermediate transfer belt 41 is an endless belt member and is wrapped around the belt transfer rollers 43 and the back-up roller 44. At least one of the belt transfer rollers 43 and the back-up roller 44 is provided with a drive unit (not shown) that rotates the intermediate transfer belt 41 in the direction of arrow D14 in FIG. 1. One or more of the belt transfer rollers 43 and the back-up roller 44 that have no drive unit are rotated by the rotation of the intermediate transfer belt 41. When the intermediate transfer belt 41 is rotated in the direction of arrow D14 in FIG. 1, the images on the intermediate transfer belt 41 are moved to the region between the second transfer roller 42 and the back-up roller 44.

Owing to a potential difference between the second transfer roller 42 and the intermediate transfer belt 41, the images on the intermediate transfer belt 41 are transferred onto the sheet of paper P that has been transported by the transport unit 16. The belt cleaner 49 removes toner that has not been transferred and that remains on the surface of the intermediate transfer belt 41. The transfer unit 14 or the transport unit 16 transports the sheet of paper P onto which the images have been transferred to the fixing unit 15. The fixing unit 15 fixes the images that have been transferred onto the sheet of paper P by applying heat thereto.

1-2. Structure of Developing Device

Figure 2:
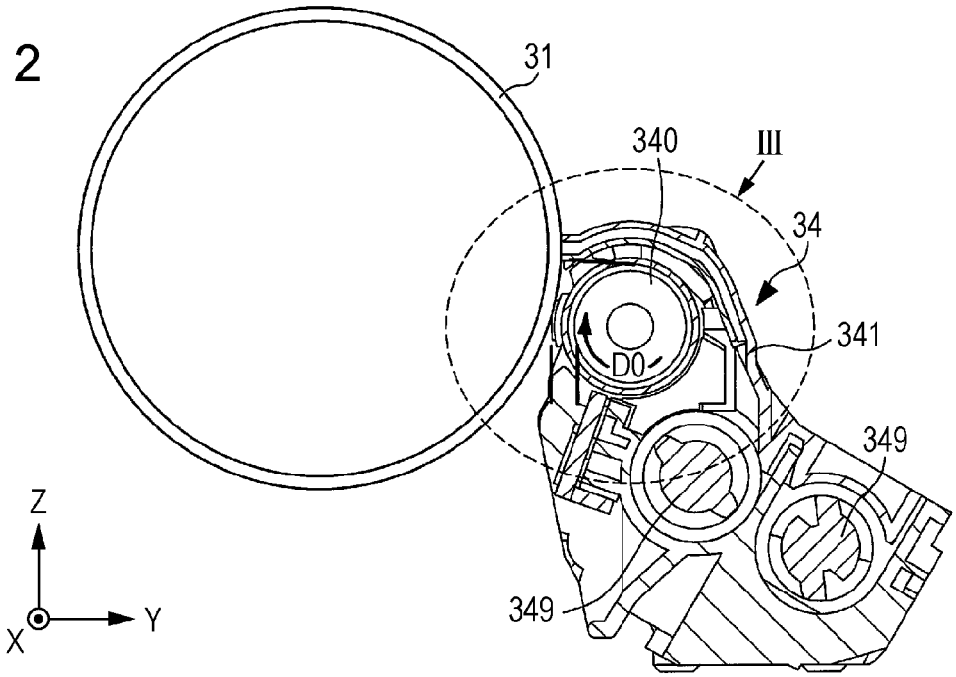
FIG. 2 illustrates the structure of a developing device.
Figure 3:
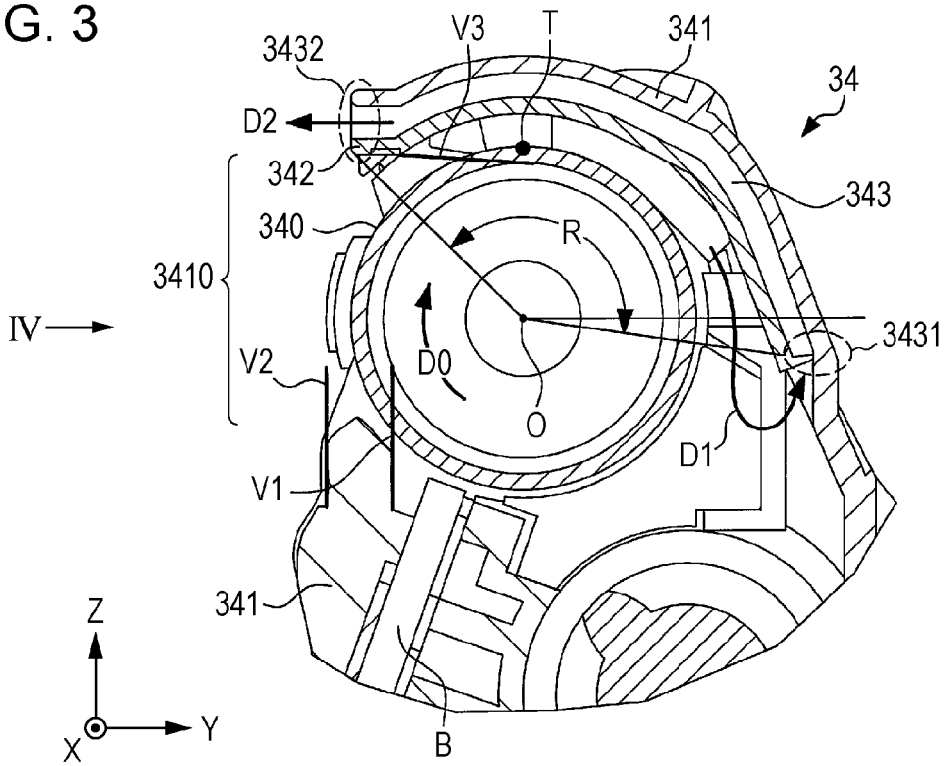
FIG. 3 is an enlarged view of part III in FIG. 2.

FIG. 2 illustrates the structure of the developing device 34. FIG. 3 is an enlarged view of part III shown in FIG. 2. As illustrated in FIG. 2, the developing device 34 is below and at the +Y-direction side of the outer peripheral surface of the image carrier 31, and includes a developer carrier 340 and two screws 349. As illustrated in FIG. 3, the developing device 34 further includes a container 341 and a discharge-path forming member 342.

The container 341 contains two-component developer containing Y, M, C, or K toner and magnetic carrier such as ferrite powder. The container 341 also contains the developer carrier 340 and the two screws 349. The container 341 has an opening 3410 that faces the image carrier 31 and at which a part of the developer carrier 340 is exposed.

The developer carrier 340 is a cylindrical member which rotates while holding the developer and supplies the developer to the image carrier 31 having an electrostatic latent image formed thereon. The developer carrier 340 is arranged so as to face the image carrier 31 in the opening 3410 of the container 341. The developer carrier 340 includes a magnet roller that serves as a magnetic-field generator that generates a magnetic field and a developing sleeve which holds the developer on a surface thereof. The magnet roller is fixed in the developing sleeve, and forms plural magnetic poles that extend along an axial direction at predetermined angular positions. When the developing sleeve passes the location of each magnetic pole of the magnet roller, the developer on the developer carrier 340 receives a magnetic force.

The developing sleeve is a nonmagnetic cylindrical member that covers the outer peripheral surface of the magnet roller. The developing sleeve rotates when a voltage is applied thereto. When the developing sleeve is rotated by a drive unit (not shown) in the direction of arrow D0 shown in FIG. 2, that is, so that the movement of a portion of the developer carrier 340 that is exposed at the opening 3410 and faces the image carrier 31 includes a vertically upward component, the developer, which receives a magnetic force from the magnet roller, is transported in the direction of arrow D0.

The two screws 349 supply the developer to the developing sleeve while stirring the developer. Owing to the magnetic force applied by the magnet roller, the developer supplied to the developing sleeve forms a magnetic brush having bristles that extend along magnetic lines of force. The thus-formed magnetic brush is retained by the developing sleeve, and is moved by the rotation of the developing sleeve to a position where the magnetic brush faces the image carrier 31. When the tips of the bristles come into contact with the surface of the image carrier 31, the toner adheres to portions of the surface of the image carrier 31 that have been exposed to light by the exposure device 33, that is, to image portions of the electrostatic latent image. Thus, an image is formed on the image carrier 31.

The discharge-path forming member 342 extends in the rotational axis direction of the developer carrier 340 along the outer peripheral surface of the developer carrier 340. The discharge-path forming member 342 covers a portion of the developer carrier 340 and forms a discharge path 343, through which the air is discharged from inside of the container 341 to outside of the container 341, between itself and the inner wall of the container 341. The discharge-path forming member 342 is supported in the container 341 by ribs (not shown) provided on portions of the inner wall surface of the container 341. The discharge-path forming member 342 covers a top portion T of a path along which the outer peripheral surface of the developer carrier 340 moves, the top portion T being located at the uppermost position of the path. An outlet 3432 of the discharge path 343 is closer to the image carrier 31 than the top portion T.

A valve V1 and a valve V2 are provided at the bottom side of the opening 3410 in the container 341. The valve V1 is in contact with the developer carrier 340 at an angle such that the distance between the valve V1 and the surface of the developer carrier 340 decreases as the developer carrier 340 rotates further in the direction of arrow D0. The valve V1 regulates the flow of air so that the developer is not easily blown toward the image carrier 31 through a gap between the developer carrier 340 and the bottom side of the opening 3410. The valve V2 is in contact with the image carrier 31 so that the developer is prevented from being diffused.

A layer regulating member B, which is a member called, for example, a trimmer bar, comes into contact with the magnetic brush formed on the surface of the developer carrier 340 that rotates in the direction of arrow D0, and scrapes off part of the magnetic brush so that the height of the magnetic brush is adjusted to a predetermined height. The developer that has been scraped off returns to the screws 349. After the height of the magnetic brush is adjusted, the magnetic brush passes through the position where it faces the image carrier 31, supplies the toner to the surface of the image carrier 31, and moves to a region R covered by the discharge-path forming member 342.

The discharge-path forming member 342 is provided with a valve V3. The valve V3 is in contact with the developing sleeve at an angle such that the distance between the valve V3 and the surface of the developing sleeve decreases as the developing sleeve rotates further in the direction of arrow D0. The valve V3 regulates the flow of air so that the developer is not easily blown toward the image carrier 31 through a gap between the developer carrier 340 and the top side of the opening 3410.

Thus, owing to the valve V1 and the valve V3, the air in the container 341 does not easily flow toward the image carrier 31 through the opening 3410. Since the magnetic brush that passes the valve V3 and reaches the top portion T moves into the container 341 together with the air, the inner pressure of the container 341 increases.

As illustrated in FIG. 3, for example, the discharge-path forming member 342 covers the region R that extends over a quarter or more of the entire outer peripheral surface of the developer carrier 340 and that includes a portion located at the top portion T. The air in the container 341 flows in the direction of arrow D1 shown in FIG. 3, enters the discharge path 343 through an inlet 3431, and is discharged through an outlet 3432 of the discharge path 343 in the direction of arrow D2, which is a direction toward the image carrier 31. Accordingly, an increase in the inner pressure of the container 341 can be suppressed. In the present exemplary embodiment, the outlet 3432 is disposed adjacent to the opening 3410.

1-3. Structure of Outlet

Figure 4:
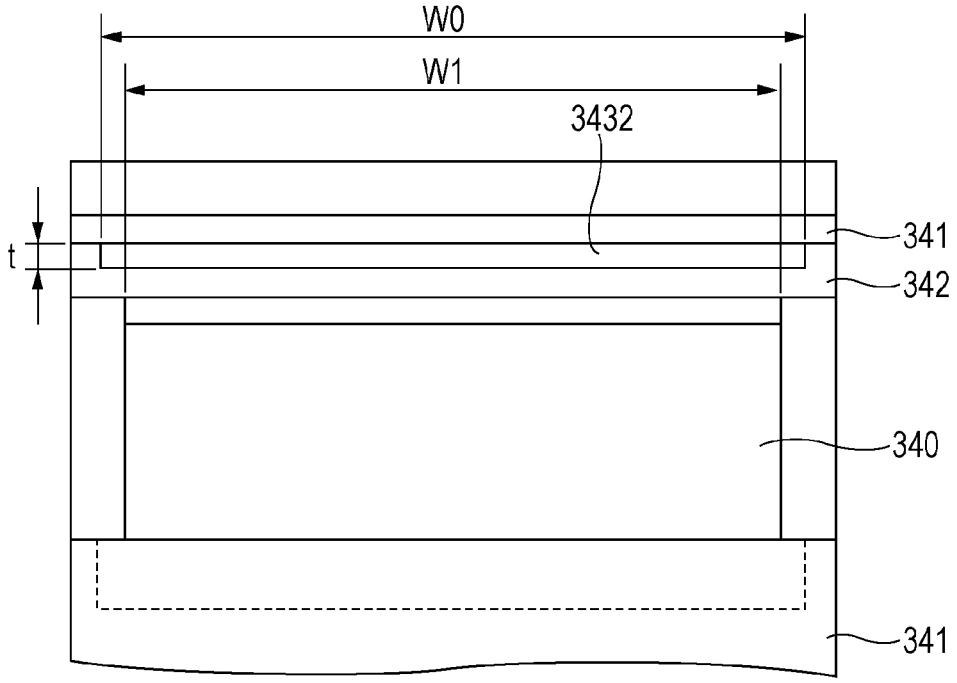
FIG. 4 illustrates the structure of an outlet.

FIG. 4 illustrates the structure of the outlet 3432. FIG. 4 illustrates the developing device 34 viewed in the direction of arrow IV in FIG. 3, that is, in the +Y direction. As illustrated in FIG. 4, the outlet 3432 of the discharge path 343 has a width w0 greater than a width w1 of the developer carrier 340 in the rotational axis direction, and extends over the entire length of the developer carrier 340 in the rotational axis direction. The outlet 3432 has a gap t of 0.2 mm or more and 2 mm or less.

1-4. Experimental Result

Figure 5:
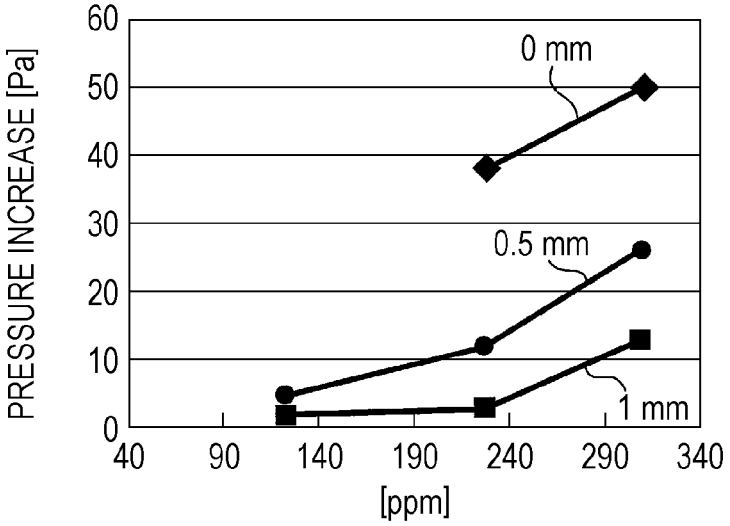
FIG. 5 is a graph showing the relationship between the gap of the outlet and the internal pressure of the developing device.

FIG. 5 is a graph showing the relationship between the gap t of the outlet 3432 and the internal pressure of the developing device 34. FIG. 5 shows the pressure increase [Pa] in the developing device 34 versus density [ppm] of toner scattered in the air in the container 341 for each gap t [mm] of the outlet 3432. Referring to FIG. 5, in the structure of the related art, the gap t is 0 [mm] since the discharge path 343 is not formed and there is no outlet 3432. According to the structure of the related art, when the toner density is, for example, about 300 ppm, the pressure increase in the developing device is as high as 50 Pa.

In contrast, with the image forming apparatus 1 according to the exemplary embodiment of the present invention, in the case where the gap t of the outlet 3432 of the discharge path 343 is t=0.5 mm, the pressure increase in the developing device is as low as about 27 Pa when the toner density is, for example, about 300 ppm. This tendency increases as the gap t of the outlet 3432 increases. In the case where the gap t of the outlet 3432 of the discharge path 343 is t=1.0 mm, the pressure increase in the developing device is about 13 Pa when the toner density is 300 ppm. This is because when the air is discharged through the outlet at a constant flow rate, the pressure drop decreases as the cross section of the outlet increases.

Figure 6:
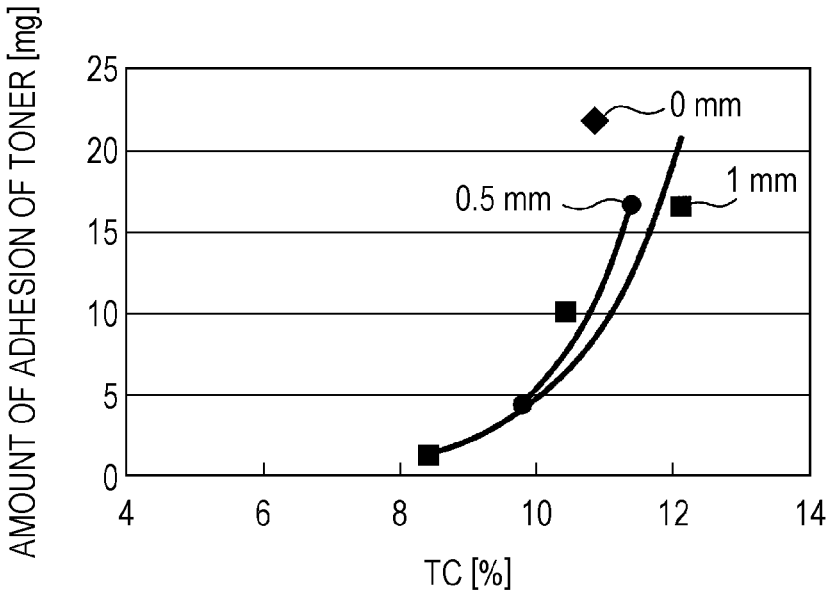

FIG. 6 is a graph showing the relationship between the gap t of the outlet 3432 and the amount of toner that adheres to a medium or the like. FIG. 6 shows the amount of toner [mg] that adheres to the medium or the like in a region other than the image versus percentage TC [%] of the magnetic carrier in the developer for each gap t [mm] of the outlet 3432. The amount of toner that adheres to the medium or the like in a region other than the image corresponds to the level of an unexpected stain of toner formed when, for example, the toner is blown out of the developing device 34. Referring to FIG. 6, in the structure of the related art, the outlet 3432 is not formed, and the amount of adhesion of the toner is about 22 mg when TC is about 11%.

In contrast, with the image forming apparatus 1 according to the exemplary embodiment of the present invention, in the case where the gap t of the outlet 3432 of the discharge path 343 is t=0.5 mm, the amount of adhesion of the toner is as small as 16 mg when TC was about 11%. This tendency increases as the gap t of the outlet 3432 increases. In the case where the gap t of the outlet 3432 of the discharge path 343 is t=1.0 mm, the amount of adhesion of the toner is about 10 mg when TC is about 10%. This is because when the air is discharged through the outlet at a constant flow rate, as the cross section of the outlet increases, the flow velocity decreases, so that the possibility that the toner mixed in the discharged air will stain the medium or the like decreases.

As described above, since the discharge path 343 is formed in the developing device 34, the possibility that the developer will be blown out through gaps in the developing device 34 and stain the medium or the like is reduced.

Since the air containing the developer tends to stay around the image carrier 31, a suction device that sucks the air that stays around the image carrier 31 is often arranged near the image carrier 31. As described above, the discharge path 343 extends toward the image carrier 31. Therefore, in the case where the suction device is provided, the air containing the developer in the container 341 of the developing device 34 may be processed by the suction device even when no additional processing device is provided.

In addition, the outlet 3432 of the discharge path 343 is disposed adjacent to the opening 3410 of the container 341. In other words, the discharge path 343 extends to a position adjacent to the opening 3410. Therefore, the air containing the developer discharged from the outlet 3432 is efficiently processed by the suction device together with the developer around the opening 3410.

The discharge path 343 extends along the outer peripheral surface of the developer carrier 340, and covers the top portion T of the path along which the outer peripheral surface moves, the top portion T being located at the uppermost position of the path. Therefore, the air that flows into the discharge path 343 through the inlet 3431 flows against the gravity until the air passes the top portion T. Accordingly, the developer contained in the air may be easily removed due to gravity before the air passes the top portion T, and the possibility that the toner contained in the discharged air will stain the medium or the like may be reduced.

2. Modifications

Although an exemplary embodiment has been described above, the exemplary embodiment may be modified as follows. The modifications described below may be employed in combination.

2-1. First Modification

In the above-described exemplary embodiment, the discharge path 343 extends toward the image carrier 31. However, it is not necessary that the discharge path 343 extend toward the image carrier 31 as long as the discharge path 343 is closer to the image carrier 31 than the top portion T.

Figure 7:
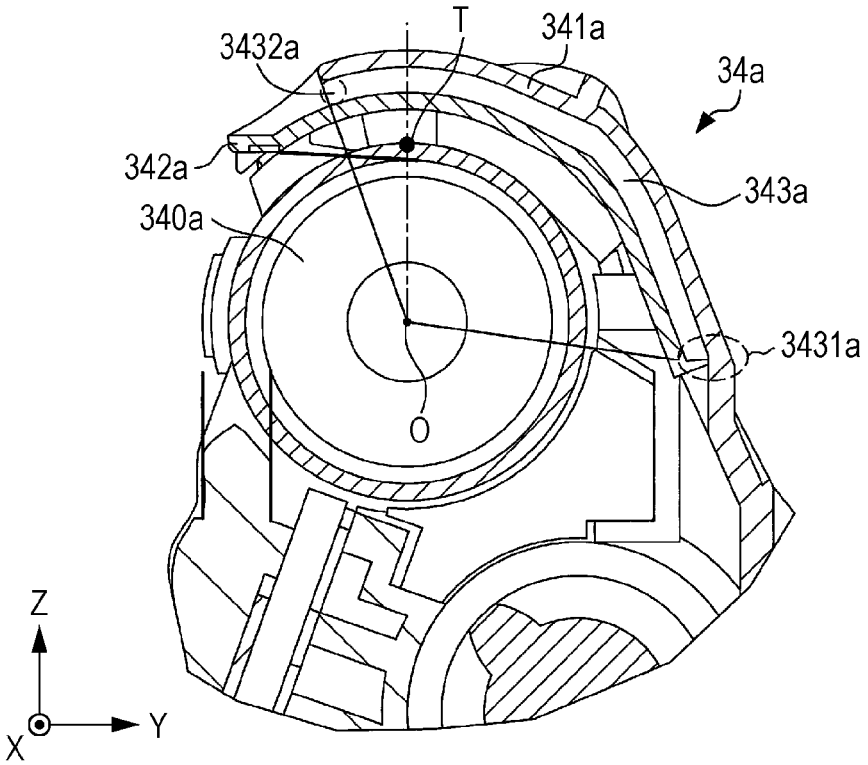
FIG. 7 illustrates the shape of a discharge path according to a modification.

FIG. 7 illustrates the shape of a discharge path 343*a* according to this modification. In this modification, a developing device 34*a* includes a developer carrier 340*a*, a container 341*a*, and a discharge-path forming member 342*a*. The developing device 34*a* differs from the above-described developing device 34 in that an image-carrier-31-side end portion (the image carrier 31 is not illustrated in FIG. 7) of a part of the container 341*a* that covers the developer carrier 340*a* from above is farther from the image carrier 31 than an image-carrier-31-side end portion of the discharge-path forming member 342*a*. Therefore, an outlet 3432*a* of the discharge path 343*a* does not face the image carrier 31. However, as illustrated in FIG. 7, the above-described image-carrier-31-side end portions of the container 341*a* and the discharge-path forming member 342*a* are both closer to the image carrier 31 than the top portion T. As a result, also in this modification, the outlet 3432*a* is closer to the image carrier 31 than the top portion T. Therefore, in the case where the above-described suction device is arranged near the image carrier 31, the air in the container 341*a* of the developing device 34*a* may be processed by the suction device even when no additional processing device is provided.

2-2. Second Modification

In the above-described exemplary embodiment, the discharge-path forming member 342 covers a region that extends over a quarter or more of the entire outer peripheral surface of the developer carrier 340 and that includes a portion located at the top portion T. However, it is not necessary that the region covered by the discharge-path forming member 342 extend over a quarter or more of the entire circumference of the developer carrier 340 as long as, for example, the inlet 3431 through which the air enters the discharge path 343 is below the rotational axis of the developer carrier 340.

2-3. Third Modification

In the above-described exemplary embodiment, the shape of the discharge path is constant at each position in the X-axis direction. However, the discharge path may instead be shaped such that the smoothness of the airflow differs at each position in the X-axis direction. In this case, the gap of the discharge path may be varied in accordance with the shape of the container in a section in which the developer is stirred. Here, "the gap of the discharge path" is the distance between the inner wall surface of the container and the outer wall surface of the discharge-path forming member.

Figure 8:
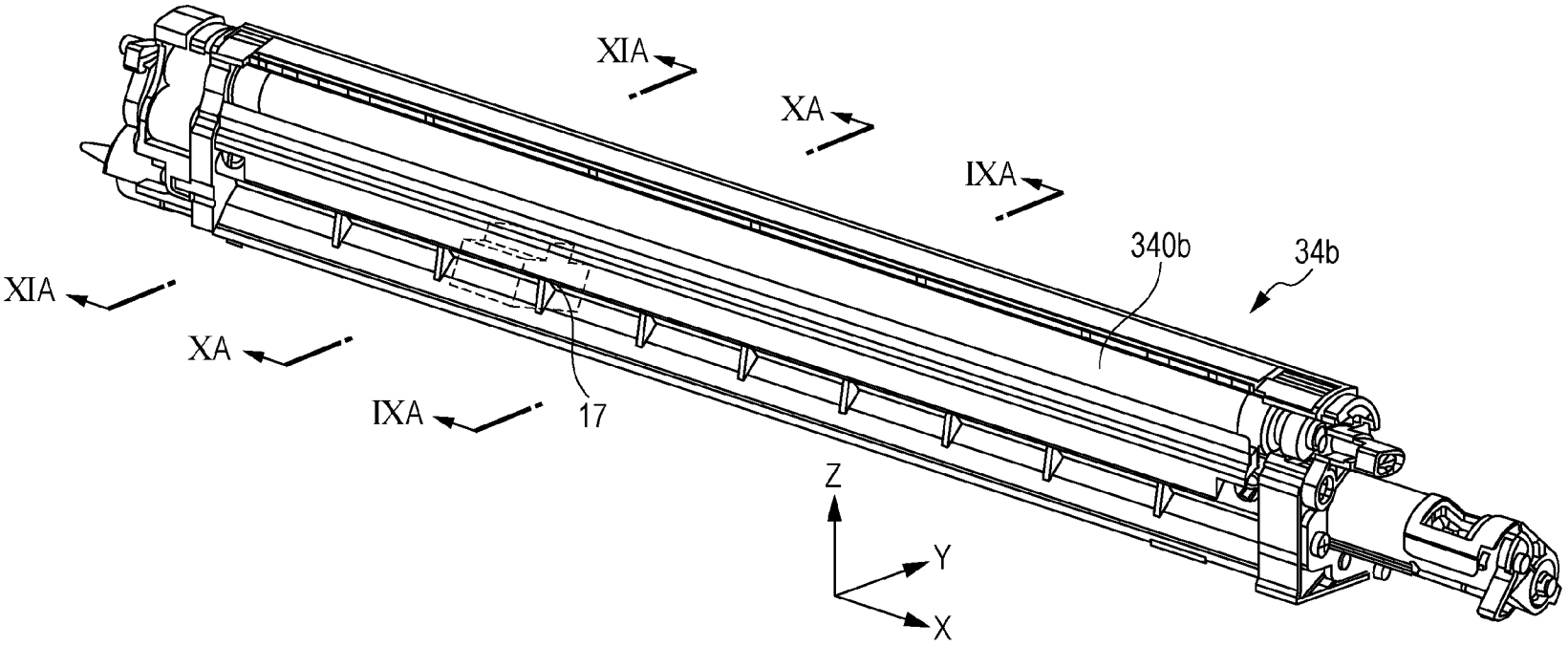
FIG. 8 illustrates a developing device according to another modification.

FIG. 8 illustrates a developing device 34*b* according to the present modification. A measurement device 17 is disposed in the developing device 34*b*. The measurement device 17 determines the density of the magnetic carrier contained in the developer by measuring the magnetic permeability. The measurement device 17 is not provided over the entire region of a developer carrier 340*b* in a rotational axis direction thereof, but is disposed near a portion of the developer carrier 340*b*.

Figure 9A:
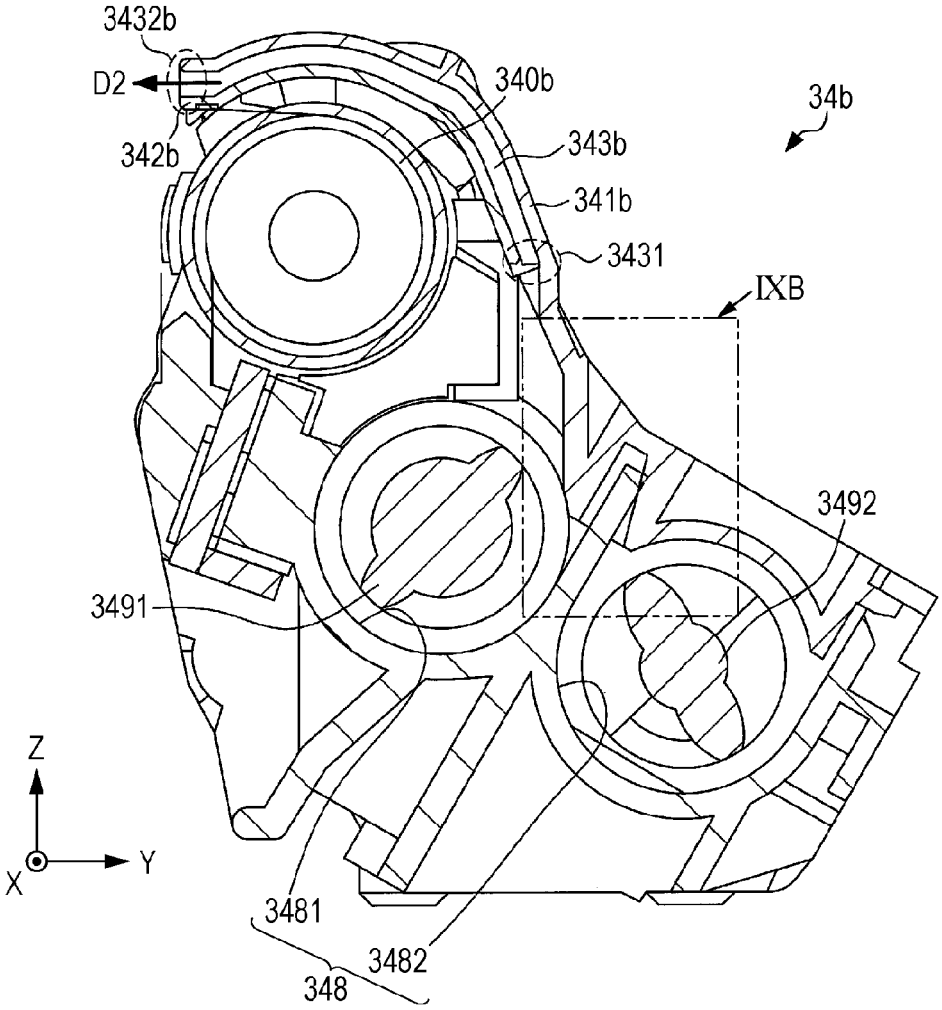
FIG. 9A is a sectional view of the developing device taken along line IXA-IXA in FIG. 8.

FIG. 9A is a sectional view of the developing device 34*b* taken along line IXA-IXA in FIG. 8. A discharge-path forming member 342*b* extends in the rotational axis direction of the developer carrier 340*b* along the outer peripheral surface of the developer carrier 340*b*. The discharge-path forming member 342*b* covers a portion of the developer carrier 340*b* and forms a discharge path 343*b*, through which the air is discharged from inside of a container 341*b* to outside of the container 341*b*, between itself and the inner wall of the container 341*b*. The air in the container 341*b* flows into the discharge path 343*b* through an inlet 3431*b* and is discharged through an outlet 3432*b*.

Figure 9B:
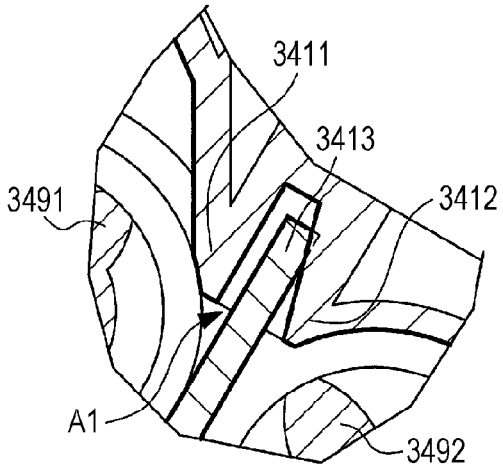
FIG. 9B is an enlarged view of part IXB in FIG. 9A.

As is clear from FIG. 9A, the measurement device 17 is not disposed at this position. FIG. 9B is an enlarged view of part IXB in FIG. 9A. The container 341*b* includes a first lid portion 3411, a second lid portion 3412, and a partitioning member 3413.

Before being supplied to the developer carrier 340*b*, the developer is stirred by two screws 3491 and 3492 in a first stirring chamber 3481 and a second stirring chamber 3482 (generically referred to as "stirring chamber 348" when it is not necessary to distinguish them). The screws 3491 and 3492 are rod-shaped members that extend in the rotational axis direction of the developer carrier 340*b*, and rotate so as to stir and transport the developer with blades provided on the outer peripheral surfaces thereof. The first stirring chamber 3481 and the second stirring chamber 3482 are chambers that extend in the rotational axis direction of the developer carrier 340*b*. The measurement device 17 is disposed in the second stirring chamber 3482 at a certain position in the rotational axis direction, but is not disposed at the position of FIGS. 9A and 9B, as described above.

First, the developer is transported in the +X direction to an end portion of the screw 3492 while being stirred by the screw 3492 in the second stirring chamber 3482, and is supplied from the end portion of the screw 3492 to the screw 3491 in the first stirring chamber 3481. Then, the developer is transported in the −X direction, which is opposite to the transporting direction of the screw 3492, while being stirred by the screw 3491 in the first stirring chamber 3481. When the developer is being transported in the −X direction by the screw 3491, the developer is supplied to the developer carrier 340*b* over the entirety of the developer carrier 340*b* in the rotational axis direction. The first stirring chamber 3481 and the screw 3491 are an example of a first supplying unit that extends in the rotational axis direction of the developer carrier and supplies the developer to the developer carrier.

The first lid portion 3411 and the second lid portion 3412 respectively cover the first stirring chamber 3481 and the second stirring chamber 3482, in which the developer is stirred, from above (from the +Z-direction side). The partitioning member 3413 separates the first stirring chamber 3481 and the second stirring chamber 3482 from each other and includes, for example, a plate-shaped member.

At the position of FIGS. 9A and 9B, a gap A1 between the first lid portion 3411 and the partitioning member 3413 is as small as, for example, 1 to 5 millimeters. The second lid portion 3412 and the partitioning member 3413 are in contact with each other, and no gap is provided therebetween. Therefore, at the position of FIGS. 9A and 9B, the amount of air in the second stirring chamber 3482 that flows into the first stirring chamber 3481 is extremely small.

Figure 10A:
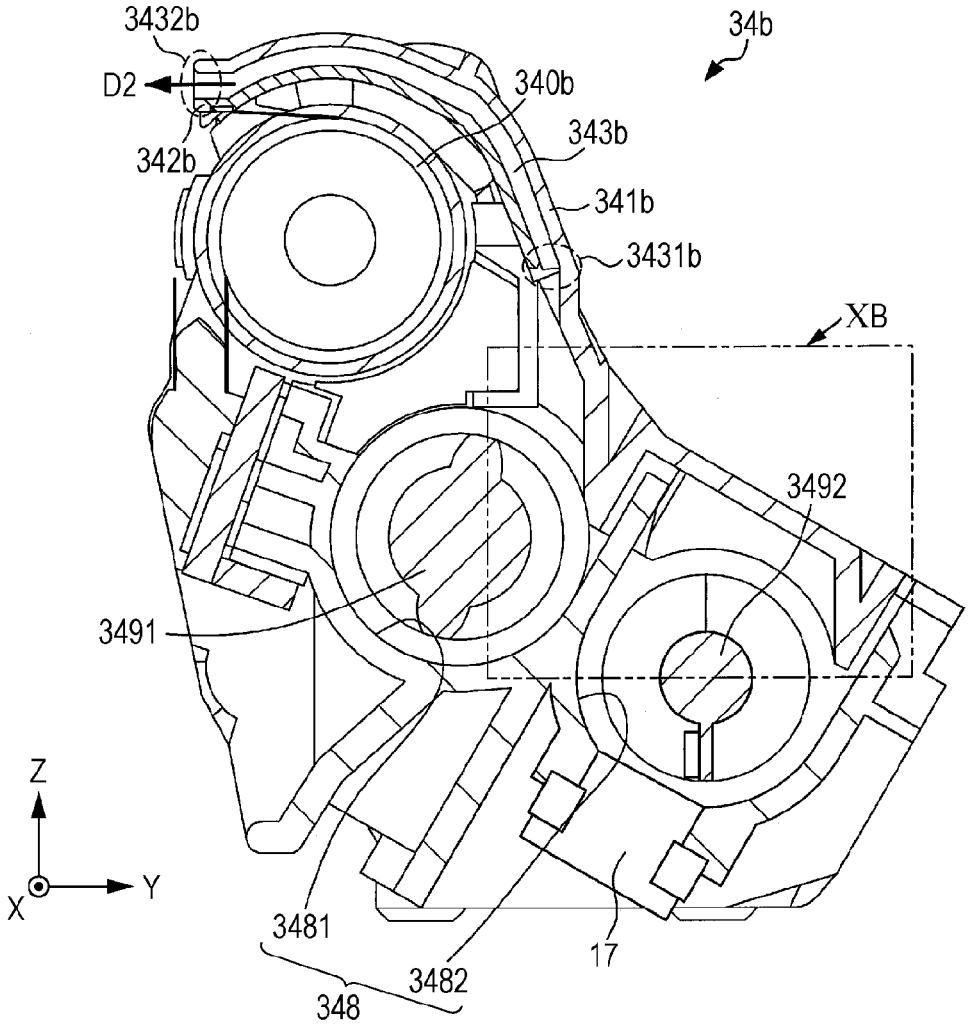
FIG. 10A is a sectional view of the developing device taken along line XA-XA in FIG. 8.
Figure 10B:
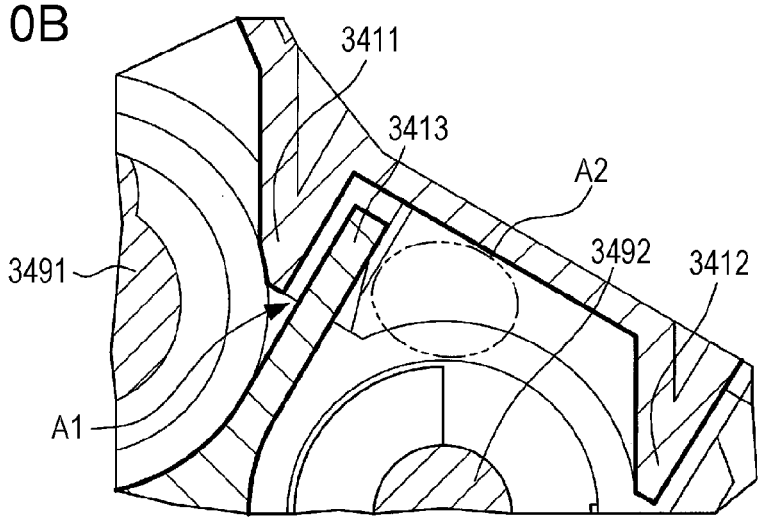
FIG. 10B is an enlarged view of part XB in FIG. 10A.

FIG. 10A is a sectional view of the developing device 34*b* taken along line XA-XA in FIG. 8. As illustrated in FIG. 10A, the measurement device 17 is disposed in the second stirring chamber 3482 at this position. FIG. 10B is an enlarged view of part XB in FIG. 10A.

At the position of FIGS. 10A and 10B, the gap A1 between the first lid portion 3411 and the partitioning member 3413 is similar to that in FIG. 9B. Also, at the position of FIGS. 10A and 10B, the second lid portion 3412 and the partitioning member 3413 are farther away from each other than at the position of FIGS. 9A and 9B, and a space A2 therebetween is larger than the above-described gap A1. Therefore, at the position of FIGS. 10A and 10B, the air in the second stirring chamber 3482 more easily flows into the first stirring chamber 3481 than at the position of FIGS. 9A and 9B. In other words, since the space A2 is formed, the second stirring chamber 3482 is provided with a passage that allows the air to flow into the first stirring chamber 3481. The screw 3492 and the second stirring chamber 3482 are an example of a second supplying unit which extends in the rotational axis direction while being spaced from the first supplying unit, which supplies the developer to the first supplying unit from an end portion thereof, and in which a passage that allows the air to flow to the first supplying unit is formed.

The reason why the space A2 is provided is as follows. That is, the measurement device 17 is disposed at the position of FIGS. 10A and 10B. To reliably measure the magnetic permeability of the developer in the second stirring chamber 3482 with the measurement device 17, the density of the developer needs to be greater than or equal to a predetermined value at the measurement position of the measurement device 17. Therefore, the number of blades of the screw 3492 is reduced at the measurement position of the measurement device 17 so that the developer accumulates at the measurement position. The amount of developer varies as the developer is transported, and the variation range is large at the measurement position where the developer is caused to accumulate. Therefore, at the measurement position, a space larger than that at the position of FIGS. 9A and 9B is required to accommodate the accumulated developer, and it is necessary to form the space A2 between the second lid portion 3412 and the partitioning member 3413.

Although it is possible to form the space A2 in the second stirring chamber 3482 and provide a plate-shaped member that extends along the partitioning member 3413 on the second lid portion 3412, it is generally difficult to form the plate-shaped member so as to be strong enough to maintain the position thereof in the developer that is being stirred.

Figure 11A:
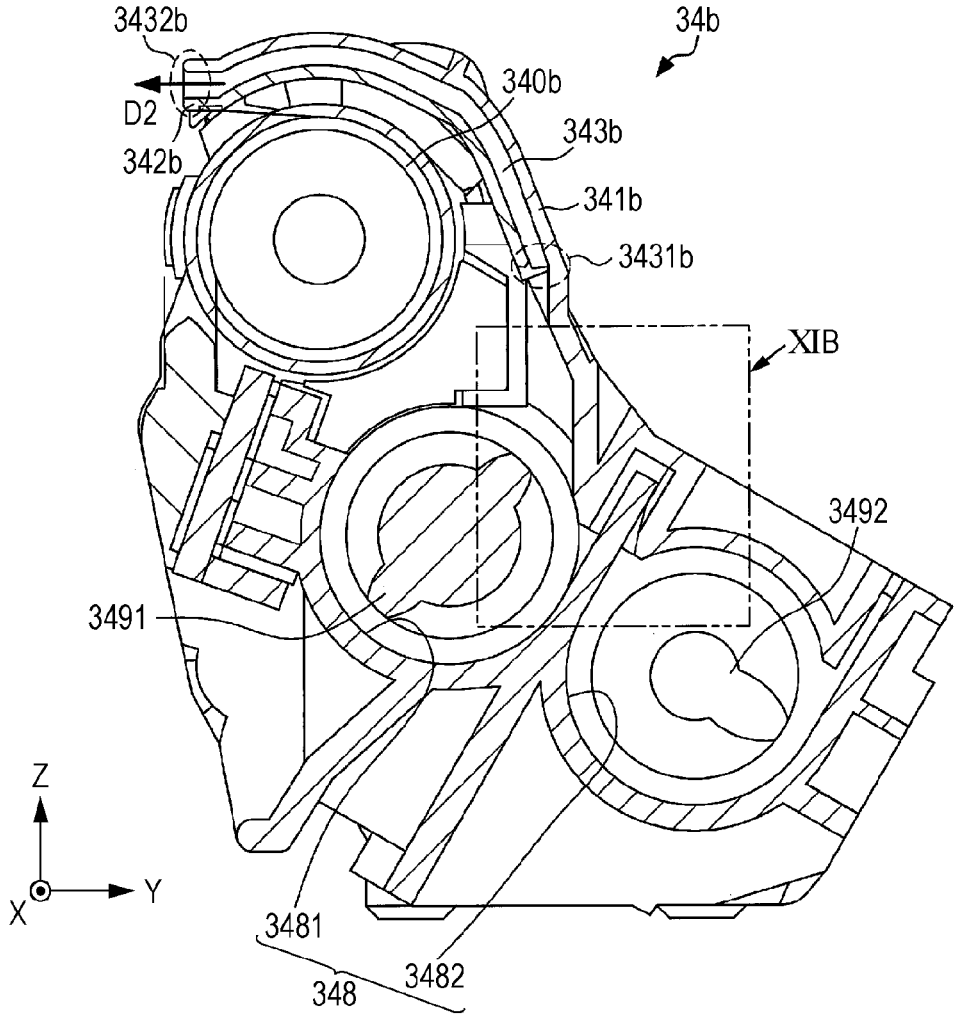
FIG. 11A is a sectional view of the developing device taken along line XIA-XIA in FIG. 8.
Figure 11B:
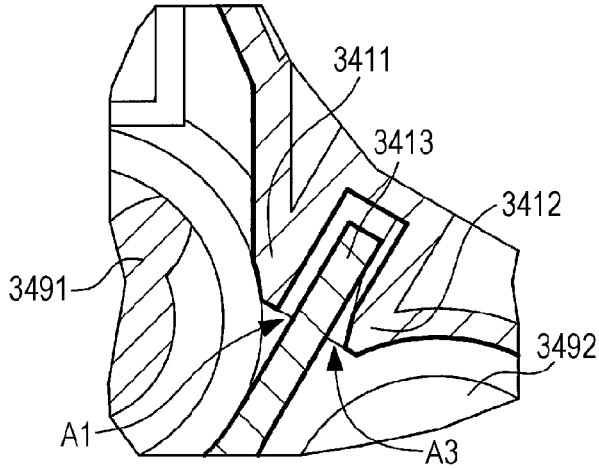
FIG. 11B is an enlarged view of part XIB in FIG. 11A.

FIG. 11A is a sectional view of the developing device 34*b* taken along line XIA-XIA in FIG. 8. As illustrated in FIG. 11A, the measurement device 17 is not disposed in the second stirring chamber 3482 at this position. FIG. 11B is an enlarged view of part XB in FIG. 11A.

At the position of FIGS. 11A and 11B, the gap A1 between the first lid portion 3411 and the partitioning member 3413 is similar to that in FIG. 9B. Also, at the position of FIGS. 11A and 11B, a gap A3 between the second lid portion 3412 and the partitioning member 3413 is greater than that at the position of FIGS. 9A and 9B and smaller than that at the position of FIGS. 10A and 10B. Therefore, at the position of FIGS. 11A and 11B, the air in the second stirring chamber 3482 more easily flows into the first stirring chamber 3481 than at the position of FIGS. 9A and 9B, and less easily flows into the first stirring chamber 3481 than at the position of FIGS. 10A and 10B.

Figure 12:
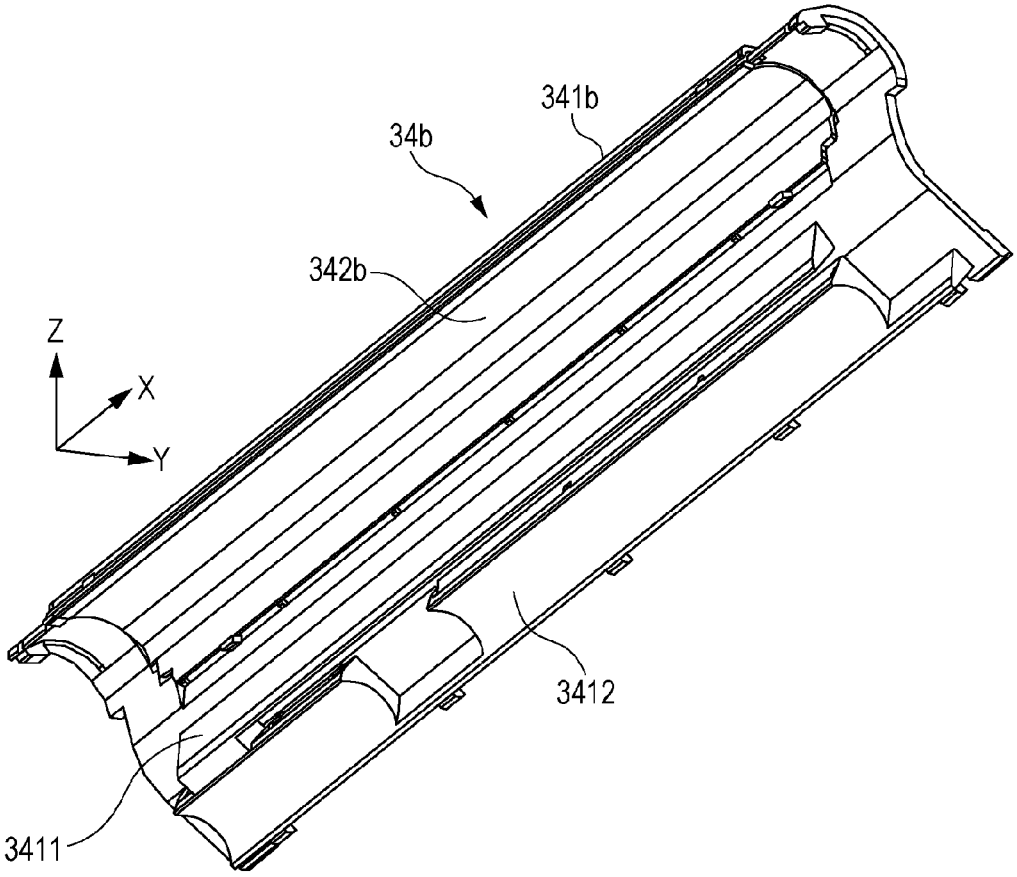
FIG. 12 illustrates a container of a developer carrier viewed from a stirring-chamber side.

FIG. 12 is a perspective view of the container 341*b* of the developing device 34*b* viewed from the stirring-chamber side. The shape of the second lid portion 3412 differs at each position in the X-axis direction.

Figure 13:
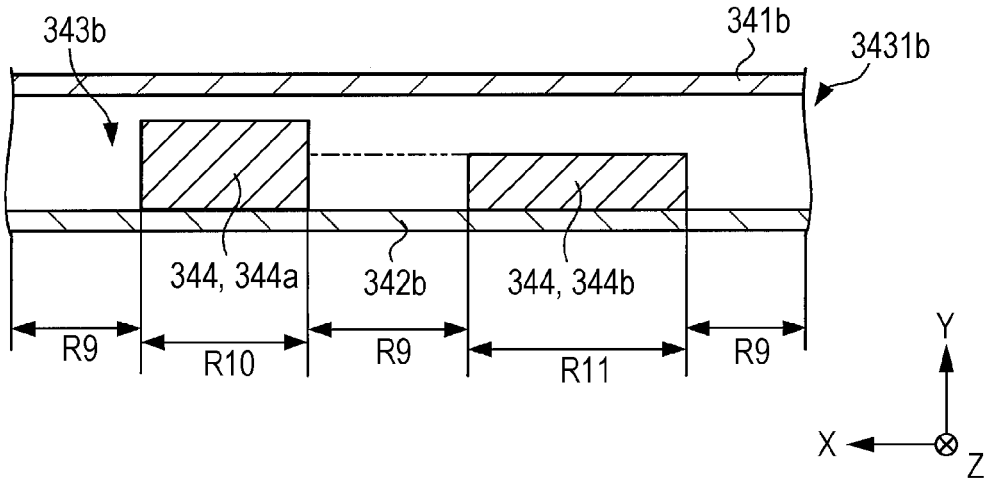
FIG. 13 illustrates an inlet of the discharge path viewed in a +Z direction.

FIG. 13 illustrates the inlet 3431*b* of the discharge path 343*b* viewed in the +Z direction. In FIG. 13, regions R9 correspond to the regions in which the second lid portion 3412 has the shape illustrated in FIGS. 9A and 9B, a region R10 corresponds to the region in which the second lid portion 3412 has the shape illustrated in FIGS. 10A and 10B, and a region R11 corresponds to the region in which the second lid portion 3412 has the shape illustrated in FIGS. 11A and 11B. Accordingly, the pressure drop of the passage that is formed in the second stirring chamber 3482 and through which the air flows into the first stirring chamber 3481 is smaller in the region R11 than in the regions R9, and is smaller in the region R10 than in the region R11 (the region in the second stirring chamber 3482 in which the measurement device 17 is disposed is the region R10 in which the pressure drop in the passage is small, as illustrated in FIGS. 10A and 10B).

The discharge-path forming member 342*b* that forms the inlet 3431*b* is provided with a barrier 344*a* in the region R10 and a barrier 344*b* in the region R11. The barrier 344*a* and the barrier 344*b* (hereinafter generically referred to as "barriers 344" when it is not necessary to distinguish them) are rectangular members that adjust the gap of the discharge path 343*b* at the inlet 3431*b*. The barrier 344*a* is longer than the barrier 344*b* in the Y direction. Therefore, the gap of the discharge path 343*b* at the inlet 3431*b* is smaller in the region R10 in which the barrier 344*a* is provided than in the region R11 in which the barrier 344*b* is provided. In other words, each portion of the discharge path 343*b* in the rotational axis direction of the developer carrier 340*b* has a size that decreases as the pressure drop in the corresponding portion of the passage through which the air flows into the first stirring chamber 3481 decreases.

As the pressure drop in the passage through which the air flows into the first stirring chamber 3481 from the second stirring chamber 3482 decreases, the gap of the discharge path 343*b* that is located downstream of the passage decreases. Therefore, in the regions where the air easily flows between the stirring chambers 348, the air does not easily flow through the discharge path 343*b*. With this structure, the velocity of the air that flows through the discharge path 343*b* is made uniform in the rotational axis direction of the developer carrier 340*b* (in the X-axis direction). As a result, even when the air carries the developer to the image carrier 31, compared to the case in which this structure is not provided, concentration of the developer in the X-axis direction may be suppressed. In other words, with this structure, the developer is not easily discharged while being concentrated at certain positions in the rotational axis direction.

Although the barriers 344 are provided on the discharge-path forming member 342*b* in the present modification, the barriers 344 may instead be provided on the container 341*b*.

In addition, although the barriers 344 are provided at the inlet 3431*b* of the discharge path 343*b*, the barriers 344 may instead be provided at the outlet 3432*b* or at other positions of the discharge path 343*b*.

2-4. Fourth Modification

Figure 14:
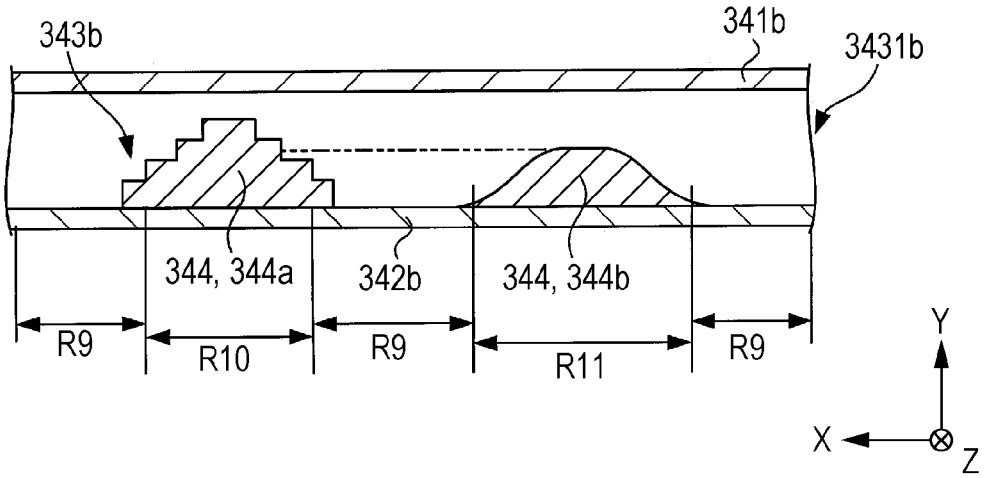
FIG. 14 illustrates the shapes of barriers according to a modification.

In the above-described third modification, the barriers 344 are rectangular members. However, the shape of the barriers 344 is not limited to a rectangular shape. FIG. 14 illustrates the shapes of barriers 344 according to the present modification. A discharge-path forming member 342*b* that forms an inlet 3431*b* is provided with a barrier 344*a* in a region R10, and with a barrier 344*b* in a region R11. The thickness, which is the length in the Y-axis direction, of the barrier 344*a* is largest at the center of the region R10 and decreases stepwise as the distance from the center increases. The thickness of the barrier 344*b* is largest at the center of the region R11, and continuously decreases as the distance from the center increases. The barriers 344 may be formed so as to protrude from the respective regions. With this structure, the velocity of the air that passes through the discharge path 343*b* is made uniform in the X-axis direction.

2-5. Fifth Modification

In the above-described third and fourth modifications, the barriers 344 are formed on the discharge-path forming member 342*b* or the container 341*b*. However, ribs, for example, may instead be formed so as to be connected to both the discharge-path forming member 342*b* and the container 341*b*. In this case, the barriers 344 may be formed such that the density thereof increases as the pressure drop in the corresponding portion of the passage through which the air flows into the first stirring chamber 3481 from the second stirring chamber 3482 decreases.

Figure 15A:
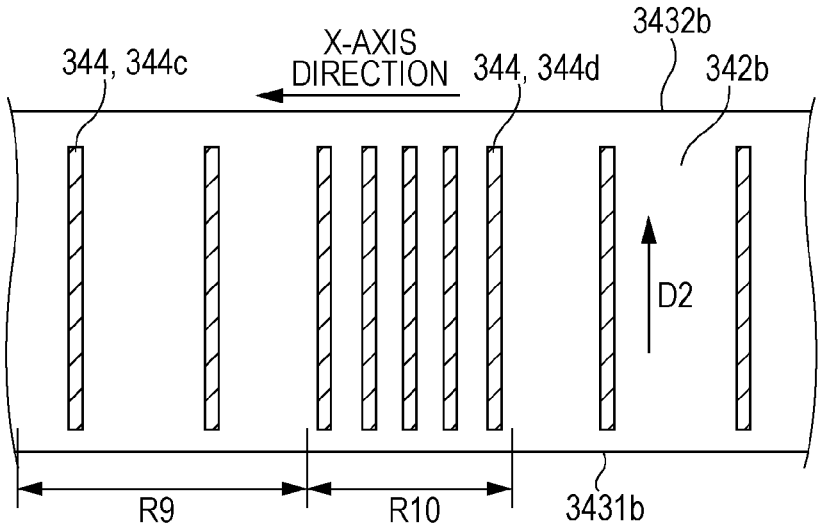
FIGS. 15A and 15B illustrate the shapes of barriers according to other modifications.
Figure 15B:
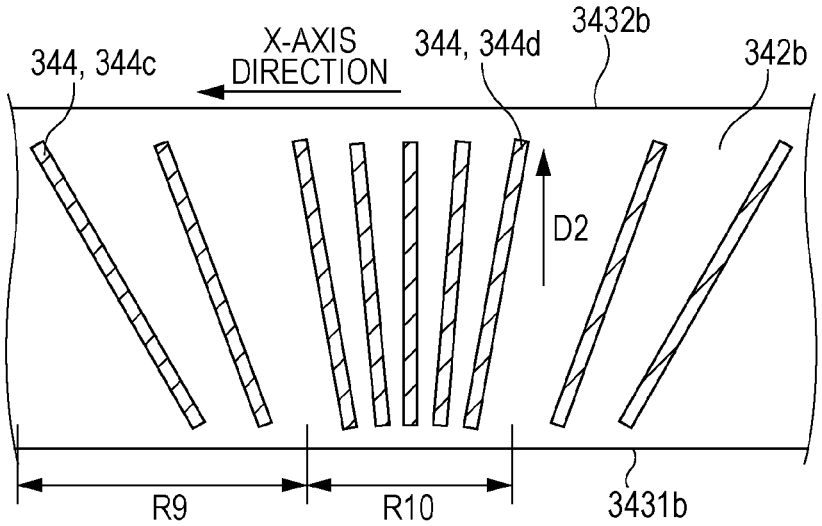

FIGS. 15A and 15B illustrate the shapes of the barriers 344 according to this modification. FIG. 15A illustrates a discharge-path forming member 342*b* viewed from a container-341*b* side. The discharge-path forming member 342*b* is provided with plural barriers 344*c* in regions R9, and with plural barriers 344*d* in a region R10.

The barriers 344 have the same width in the X-axis direction and extend in the direction of arrow D2 (direction in which the air is discharged). The density of the barriers 344*d* in the region R10 in the X-axis direction is higher than that of the barriers 344*c* in the regions R9. With this structure, the air less easily passes through the discharge path 343*b* in the region R10 than in the regions R9. As a result, the velocity of the air that passes through the discharge path 343*b* is made uniform in the X-axis direction.

It is not necessary that the barriers 344 extend in a direction perpendicular to the X-axis direction. For example, as illustrated in FIG. 15B, barriers 344*d* may be formed in a region R10 so as to extend obliquely with respect to the direction of arrow D2 such that the intervals therebetween are larger at an outlet 3432*b* than at an inlet 3431*b*. With this structure, the velocity of the air that passes through the discharge path 343*b* is made further uniform in the X-axis direction.

The barriers 344 are not limited to those described above, and may instead be, for example, a metal mesh. The barriers 344 are not limited as long as they reduce the cross section of the discharge path 343*b* so that a pressure drop occurs and the smoothness of airflow from the inlet 3431*b* to the outlet 3432*b* is reduced.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer carrier that has a cylindrical shape and that is configured to rotate while carrying developer to supply the developer to an image carrier on which an electrostatic latent image is formed;

a container that contains the developer carrier;

a discharge-path forming member that is provided along an outer peripheral surface of the developer carrier, that covers a top portion of a path along which the outer peripheral surface moves, the top portion being located at an uppermost position of the path, and that forms a discharge path configured to discharge air from inside of the container to outside of the container, between the discharge-path forming member and an inner wall surface of the container, the discharge path having an outlet located closer to the developer carrier than the top portion;

a first supplying unit that extends in a rotational axis direction of the developer carrier and that is configured to supply the developer to the developer carrier; and a second supplying unit that extends in the rotational axis direction while being spaced from the first supplying unit, that is configured to supply the developer to the first supplying unit from an end pc ion of the second supplying unit, and in which a passage that allows the air to flow to the first supplying unit is formed, wherein each portion of the discharge path in the rotational axis direction has a size that decreases as a pressure drop in a corresponding portion of the passage decreases.

2. The developing device according to claim 1, wherein the discharge path extends toward the image carrier.

3. The developing device according to claim 1, wherein the container has an opening at which a portion of the developer carrier is exposed and faces the image carrier, and wherein the outlet is located adjacent to the opening.

4. The developing device according to claim 1, wherein the outlet extends over the entire region of the developer carrier in a rotational axis direction.

5. The developing device according to claim 1, wherein the discharge-path forming member covers a quarter or more of the outer peripheral surface of the developer carrier.

6. The developing device according to claim 1, wherein an inlet through which the air enters the discharge path is located below a rotational axis of the developer carrier.

7. The developing device according to claim 1, wherein the second supplying unit includes a measurement device configured to measure the developer, the measurement device being disposed in a region in the rotational axis direction in which the pressure drop of the passage is small.

8. An image forming apparatus comprising:

the developing device according to claim 1;

the image carrier configured to carry the electrostatic latent image and to receive the developer from the developing device; and a transfer unit configured to transfer an image from the image carrier onto a medium, the image being developed by the developer supplied from the developing device.

* * * * *